US006594937B2

(12) United States Patent
Weichert et al.

(10) Patent No.: US 6,594,937 B2
(45) Date of Patent: Jul. 22, 2003

(54) SIGHTING DEVICE FOR A GRENADE LAUNCHER MOUNTED ON A FIREARM

(75) Inventors: Berthold Weichert, Zimmern (DE); Gerhard Gielke, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 10/008,737

(22) Filed: Dec. 6, 2001

(65) Prior Publication Data

US 2002/0092224 A1 Jul. 18, 2002

Related U.S. Application Data

(63) Continuation of application No. PCT/EP00/04946, filed on May 30, 2000.

(30) Foreign Application Priority Data

Jun. 7, 1999 (DE) ..... 199 25 863

(51) Int. Cl.[7] ..... F41C 27/06
(52) U.S. Cl. ..... 42/105; 42/125; 42/128
(58) Field of Search ..... 42/105, 125, 128

(56) References Cited

U.S. PATENT DOCUMENTS

| | | | | | |
|---|---|---|---|---|---|
| 719,011 | A | * | 1/1903 | Kennedy | |
| 2,345,801 | A | * | 4/1944 | Ferrel | 33/55 |
| 3,165,836 | A | | 1/1965 | Magrado | 33/47 |
| 3,986,285 | A | * | 10/1976 | Krisay | 42/127 |
| 4,016,652 | A | * | 4/1977 | Stratman | 42/137 |
| 4,689,910 | A | * | 9/1987 | Choate et al. | 42/111 |
| 4,962,589 | A | * | 10/1990 | LaRosa | 42/111 |
| 5,340,115 | A | | 8/1994 | Shirai et al. | 273/310 |
| 5,590,484 | A | * | 1/1997 | Mooney et al. | 42/111 |
| 5,606,818 | A | | 3/1997 | Hardee | 42/101 |
| 5,659,965 | A | * | 8/1997 | Thibodeau et al. | 42/126 |
| 5,930,935 | A | * | 8/1999 | Griffin | 42/105 |
| 6,134,823 | A | * | 10/2000 | Griffin | 42/105 |

FOREIGN PATENT DOCUMENTS

| | | |
|---|---|---|
| DE | 19 44 650 A | 3/1971 |
| DE | 42 44 349 A1 | 12/1992 |
| EP | 0 085 193 A1 | 8/1983 |

OTHER PUBLICATIONS

*International Search Report*, corresponding to International Patent Application Serial No. PCT/EP00/04946, European Patent Office, dated Sep. 25, 2000, 4 pages.

*International Preliminary Examination Report* and *Translation* corresponding to International Patent Application Serial No. PCT/EP00/004946, dated Aug. 12, 2001, 7 pages.

* cited by examiner

*Primary Examiner*—Michael J. Carone
*Assistant Examiner*—M. Thomson
(74) *Attorney, Agent, or Firm*—Grossman & Flight, LLC

(57) ABSTRACT

A sighting device is provided for a grenade launcher of a firearm which includes an automatic weapon and a grenade launcher. The sighting device can be attached to either side of the firearm to facilitate left-handed or right-handed shooting. The sighting device includes a front sight and a rear sight. Each of the front and rear sights are mounted for pivoting movement between a resting or storage position and a sighting position.

8 Claims, 4 Drawing Sheets

SIGHTING DEVICE FOR A GRENADE LAUNCHER MOUNTED ON A FIREARM

RELATED APPLICATION

This patent is a continuing application which claims priority under 35 U.S.C. §120 from International patent application No. PCT/EP00/04946, filed May 30, 2000.

FIELD OF THE INVENTION

The invention relates generally to firearms, and, more particularly, to a sighting device for a grenade launcher mounted on a firearm

BACKGROUND OF THE INVENTION

An automatic weapon with a grenade launcher attached to it underneath its barrel is known from U.S. Pat. No. 3,165,836. The ballistics of the small-caliber, very fast gun bullet and the comparably sluggish, but very large-caliber grenade shell are so different that the gun sight cannot be sufficiently adapted to permit satisfactory targeting during the launching of grenades.

SUMMARY OF THE INVENTION

In accordance with an aspect of the invention, a firearm is provided which includes an automatic weapon having a barrel, and a grenade launcher attached underneath the barrel of the automatic weapon. The firearm also includes at least two mounting surfaces. The at least two mounting surfaces are located on opposite sides of the firearm. The firearm also includes an open sighting device for the grenade launcher. The sighting device has an off-center line of sight and includes a carrier component for selective attachment to either of the at least two mounting surfaces. The sighting device also includes a sight carrier detachably attached to the carrier component such that, upon detaching the carrier component and the sight carrier from a first one of the at least two mounting surfaces and reattaching the carrier component and the sight carrier to a second one of the at least two mounting surfaces, the sight carrier can be detached from the carrier component, reversed in orientation, and reattached to the carrier component. The sighting device also includes a front sight on a first side of the sight carrier, and a rear sight blade on a second side of the sight carrier.

In accordance with another aspect of the invention, a sighting device is provided for a grenade launcher of a firearm including an automatic weapon and a grenade launcher. The sighting device includes a mounting bracket adapted to be removably attached to either of a first side and a second side of the firearm. The first side is opposite the second side. The device also includes a sight mount adapted to be attached to the mounting bracket in a first orientation when the mounting bracket is attached to the first side of the firearm and to be attached to the mounting bracket in a second orientation when the mounting bracket is attached to the second side of the firearm. The sight mount defines a first recess and a second recess. The sighting device further includes a front sight pivotably attached to the sight mount for movement between a sighting position in which the front sight is disposed in a generally upright position and a rest position in which the front sight is at least partially disposed within the first recess, and a rear sight pivotably attached to the sight mount for movement between a sighting position in which the rear sight is disposed in a generally upright position and a rest position in which the rear sight is at least partially disposed within the second recess. The front sight and the rear sight are offset from a center axis of the firearm.

In accordance with another aspect of the invention, a method of readying a firearm including an automatic weapon and a grenade launcher for firing the grenade launcher is provided. The method includes the steps of: if an intended shooter is right handed, mounting a sighting device on a first side of the firearm; if an intended shooter is left handed, mounting the sighting device on a second side of the weapon opposite the first side; pivoting a front sight from a resting position to a sighting position; and pivoting a rear sight from a resting position to a sighting position.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
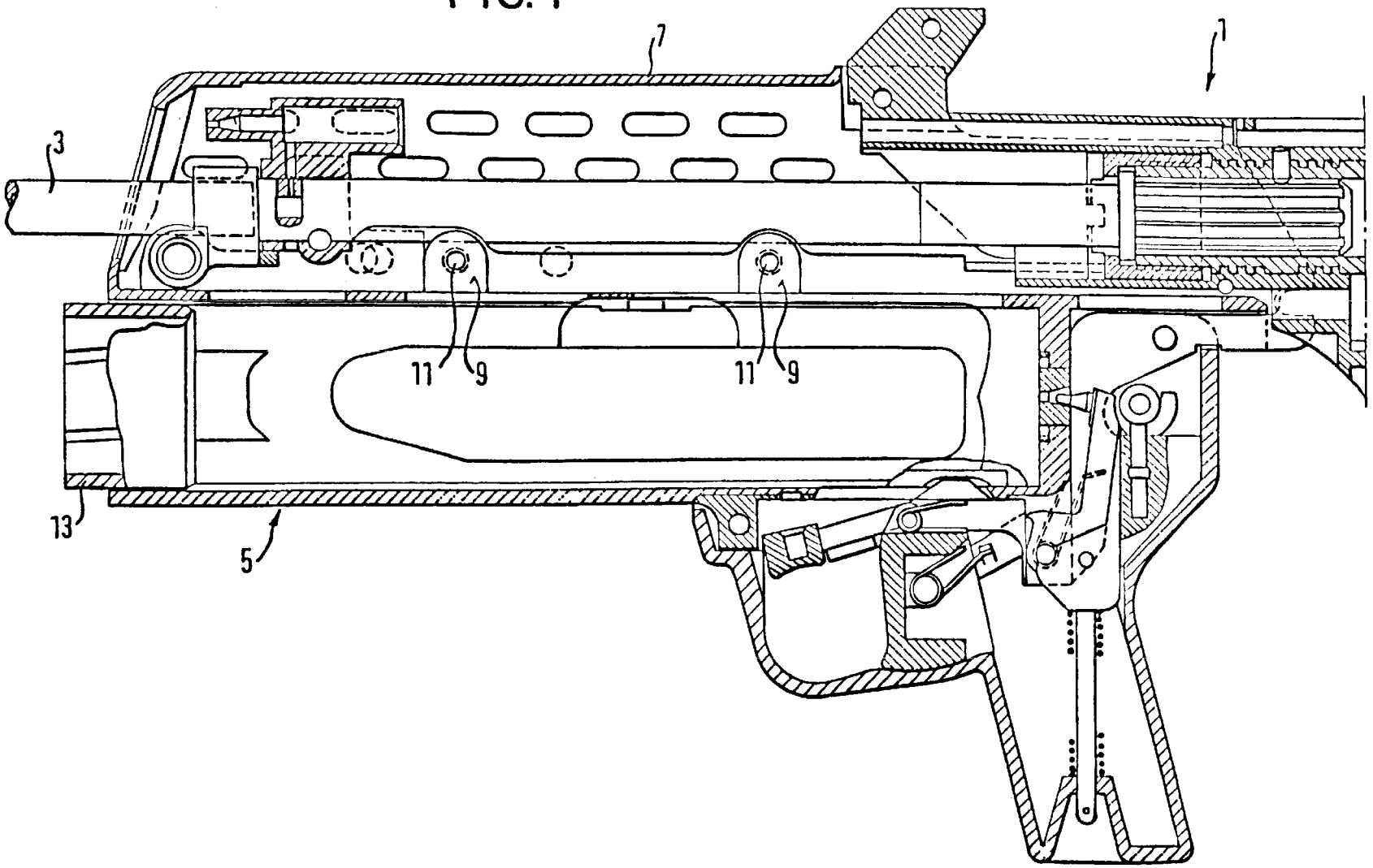
FIG. 1 is a longitudinal sectional view through the front portion of an automatic weapon constructed in accordance with the teachings of the instant invention.

For ease of comprehension, conventional parts that do not play a key role in explaining the disclosure are not depicted in the drawings. The reference numerals are used consistently through all of the figures.

FIG. 1 depicts the front portion of an automatic weapon 1 constructed in accordance with the teachings of the invention. The weapon 1 includes a barrel 2 and a gun sight 33 (see FIG. 2). Under the barrel 2, a rifle grenade device 5 is attached. The grenade device 5 includes a swing-out barrel 13. A hand guard 7 is arranged above the rifle grenade device 5 and the gun barrel 3. On the rifle grenade device 5, a mounting surface is formed on each side of the barrel 13 and adjacent to the hand guard 7. This mounting surface comprises two partial surfaces 9, into each of which a centered screw hole 11 feeds.

Each of the two partial surfaces 9 on each side of the weapon 1 is positioned in a shared, flat geometric surface. The partial surfaces 9 are parallel to a vertical longitudinal center surface, which accepts the two axes of the bore of the two barrels 3, 13. The two pairs of partial surfaces 9 are arranged in parallel to this longitudinal center plane.

The screw holes 11 feature an inlet segment that forms an alignment hole.

Figure 2:
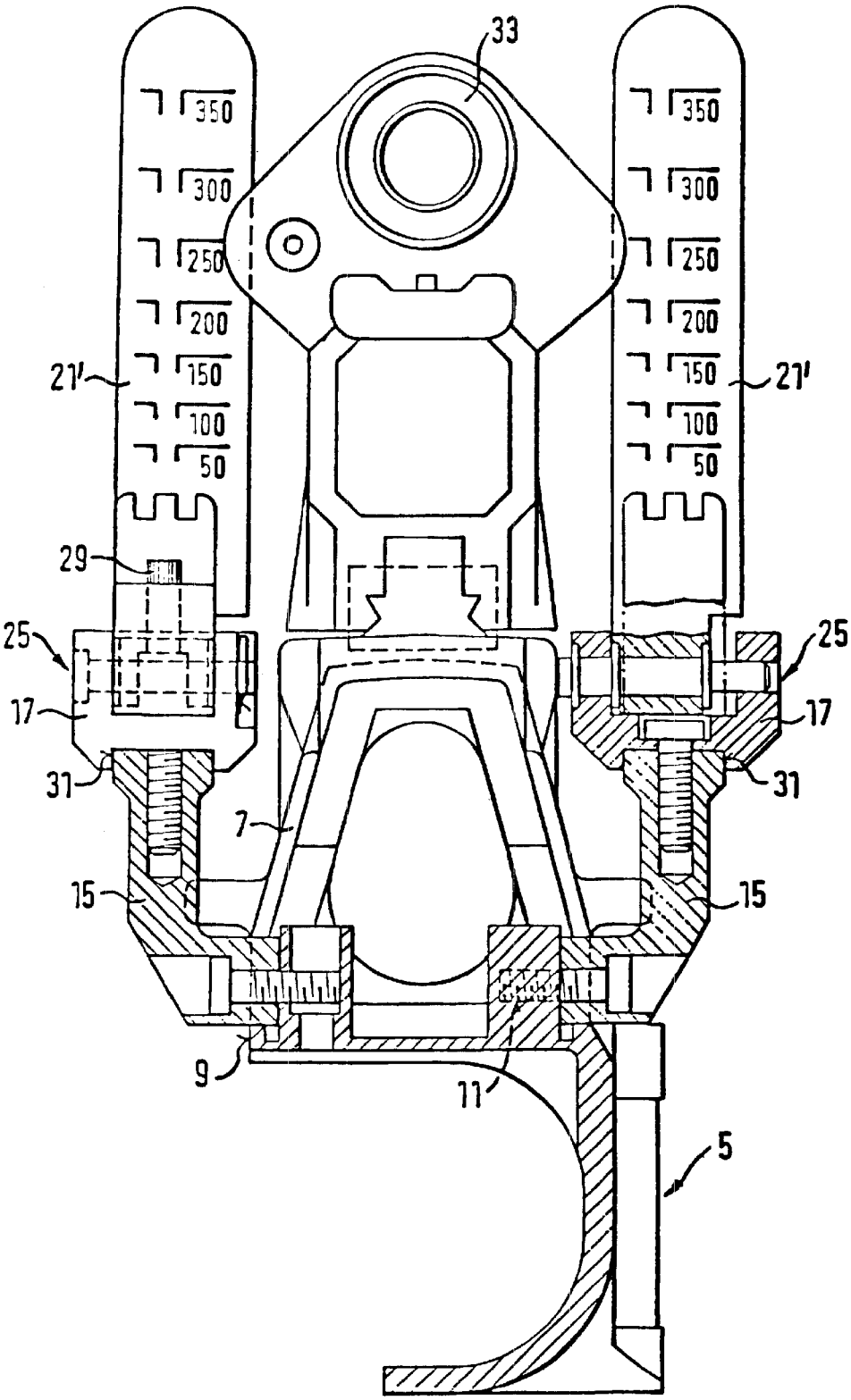
FIG. 2 is a partially cut-off view of the weapon of FIG. 1 seen from the rear.
Figure 3:
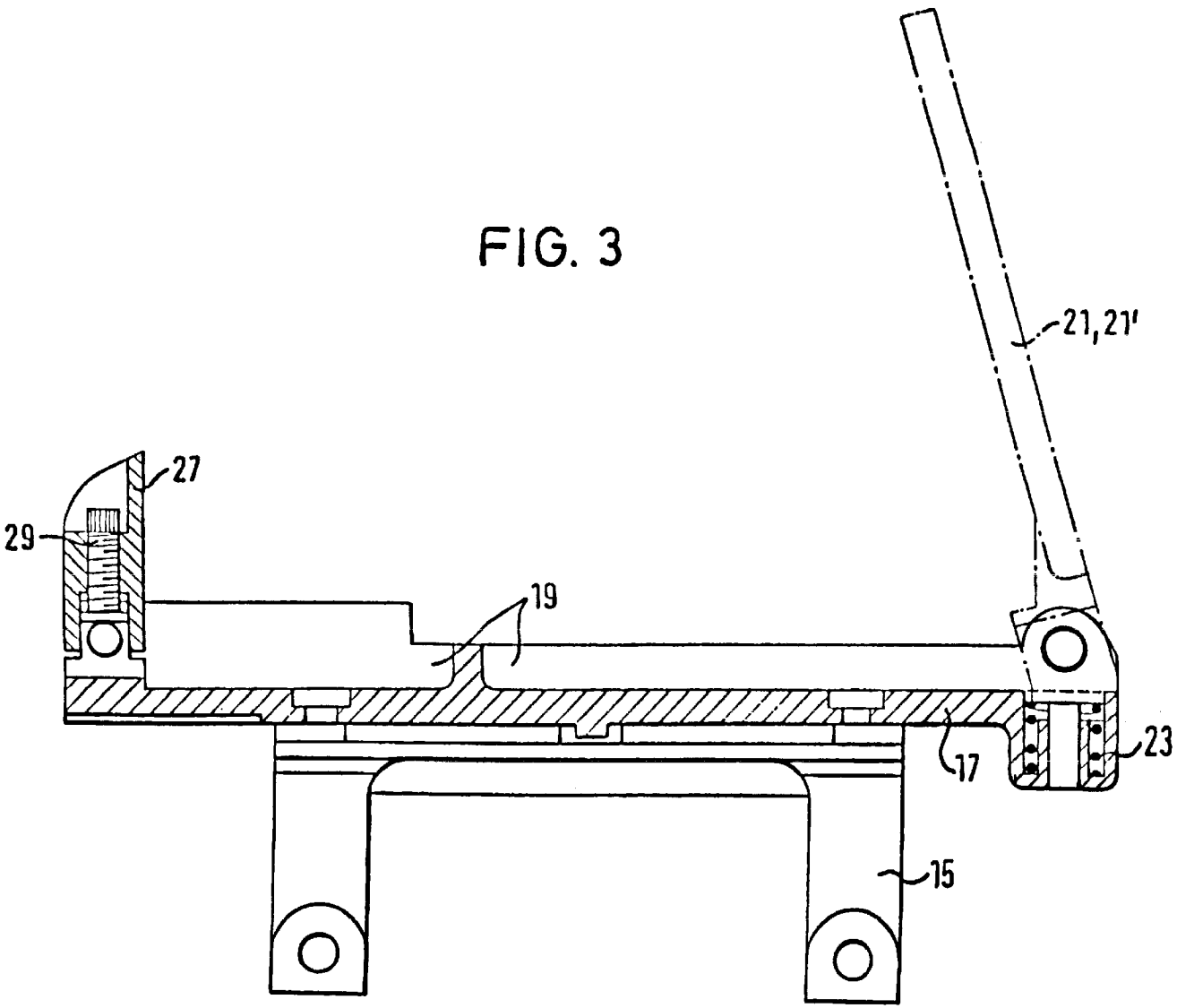
FIG. 3 is a partially cut-off side view of the mounting device and sighting device.

The mounting and sighting device to be screwed to the screw holes 11 is depicted in FIG. 2 in cross-section and in FIG. 3 in longitudinal section.

The mounting device comprises a carrier component 15. Carrier component 15 features a horizontal carrier and two vertically progressing feet angled at right angles at the bottom. The vertical end surfaces of the feet facing the weapon 1, 5 are fine machined like the partial surfaces 9, adjoin these surfaces 9, and are perforated by an alignment hole. When the aforementioned end surfaces of the carrier component 15 are placed against the partial surfaces 9, the alignment holes become aligned with the screw holes 11, and the carrier component 15 can be screwed to the grenade launcher 5 as shown in FIG. 2. The shaft of each screw is formed as an alignment pin, which passes through the horizontal alignment hole in the foot of the carrier component 15 and enters the opening of the screw holes 11, thereby bringing each screw hole into perfect alignment with each alignment hole. The carrier component 15 is, thus, attachable to the grenade launcher 5 in a reproducible manner.

The upper part of the carrier component 15 forms a straight-lined, horizontal rail with parallel flanks. A sight carrier 17 is provided which defines a longitudinal groove 31 which fits onto the horizontal rail of the carrier component 15. The sight carrier 17 can be placed onto the carrier component 15 in such a way that the sight carrier 17 optionally points toward either the front or the back. As shown in FIG. 2, two screws pass vertically through the sight carrier 17 and engage screw holes in the carrier component 15, each of which is spaced equidistant to the nearest end of the longitudinal groove 31.

On its upper side, the sight carrier 17 features two recesses 19 (see FIG. 3). On the front end of the front recess 19, a front sight 27 is articulated in such a way that it can be tilted back and forth between a vertical position (e.g., a sighting position) and a horizontal position (e.g., a rest position). In the horizontal position, the front sight 27 is essentially entirely enclosed in its recess 19. For this reason, its side wall is higher than that of the rear recess 19, which accepts a rear sight blade 21 when it is tilted from its vertical to its horizontal position.

A height adjustment device 29 is provided to adjust the vertical position of the front sight 27. A lateral adjustment device 25 is provided to adjust the lateral position of the rear sight blade 21.

In addition, a locking spring 23 is provided to hold the rear sight blade 21 in its vertical or its horizontal position. FIG. 3 shows the rear sight blade 21 in an intermediate position between the resting position and the sighting position.

In FIG. 2, two mounting devices 15, 17 with two sighting devices 21, 27 are attached to the grenade launcher 5, with one attached on each side. This arrangement is possible, and in some cases advantageous, but is generally not necessary. Instead, only one of these subassemblies is preferably attached to the mounting surface (partial surfaces 9), indicted by the marksman's shooting habit (e.g., right-handed or left-handed marksman). The carrier component 15 points either forward or backward, depending on whether the angled portions of its feet point to the right or left. However, the sight carrier 17 and the sighting device 21, 27 are secured to the carrier component 15 and oriented in such a way that the front sight always points forward. This may require reversing the orientation of the sight carrier 17 relative to the carrier component 15.

Figure 4:
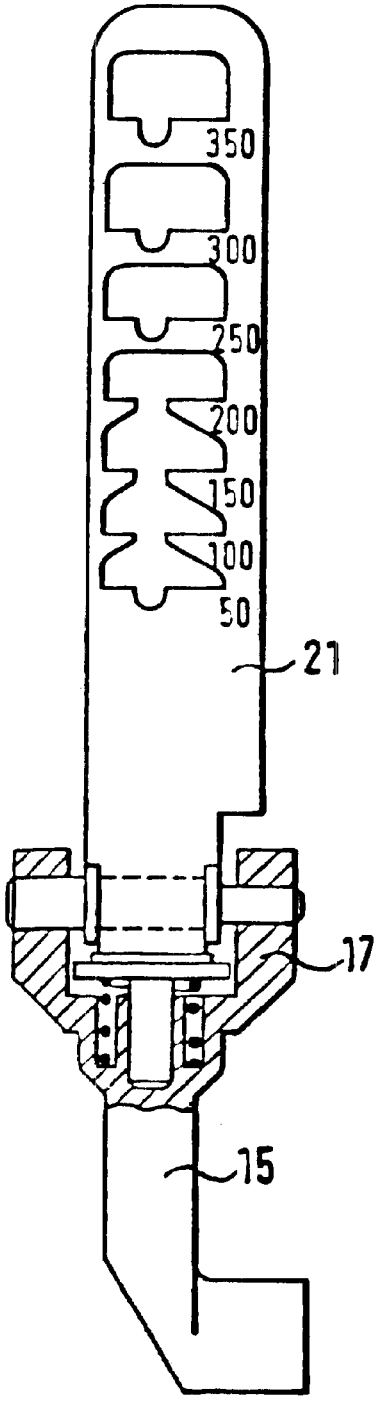
FIG. 4 illustrates a first exemplary sight blade.

FIG. 4 depicts the mounting and sighting device in its sighting position, specifically in a vertical section perpendicular to the longitudinal center axis, viewed from slightly behind the sight blade 21 and from the back. The sight blade 21 is made of a material that is sufficiently opaque so that edges are distinguished as clear contours relative to the target.

Superimposed recesses interrupted by the material of the rear sight blade describe superimposed rear sights (i.e., individual horizontal edges, each having a centered notch). Next to each recess, a number is affixed that indicates the distance at which one obtains a point shot by using the applicable rear sight for targeting. As is evident, the lower, densely superimposed recesses merge into one another. This type of rear sight blade can be manufactured, for example, by punching it from a sheet metal or plastic strip, or by means of plastic injection molding.

Figure 5:
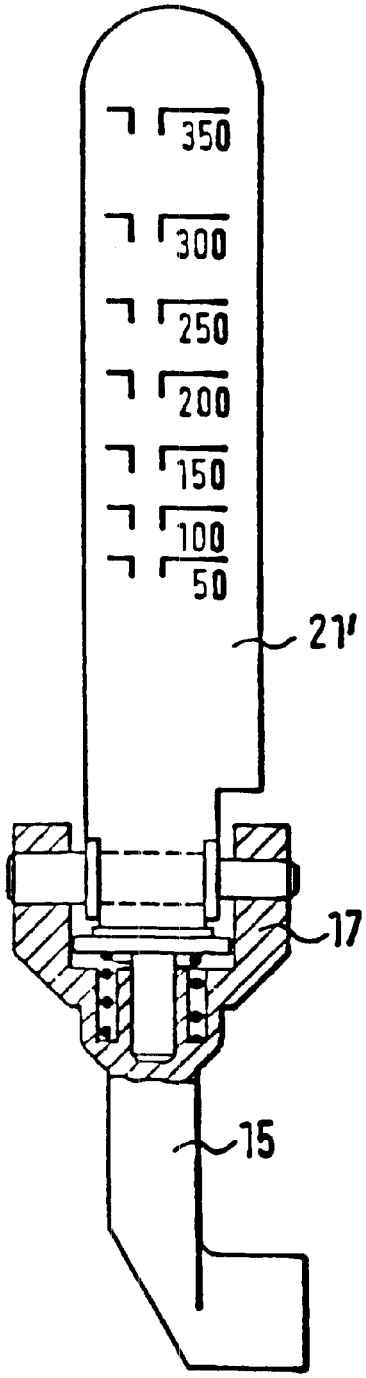
FIG. 5 illustrates a second exemplary sight blade.

FIG. 5 depicts another exemplary rear sight blade 21'. Rear sight blade 21' is made of transparent material, onto which linear aims are superimposed, with a distance code being assigned to each linear aim. The rear sight blade 21' is preferably made of glass-clear polycarbonate, or similar material, in an injection molding process. The lack of recesses in the rear sight blade 21 gives the rear sight blade 21' superior strength to sight blade 21. Furthermore, no portion of the target area is blocked by the rear sight blade, which is in contrast to the opaque rear sight blade. Instead, the entire target area always remains fully within the visual field of the marksman.

The line-shaped aims and the lettering can be shaped in the form of deep grooves during diecasting. In this case, it is also possible to either structurally incorporate a battery-operated illumination device into the sight carrier 17, or to place such a device over the rear sight blade 21' from above; in this case, all recessed lines become illuminated, so that targets that are still visible during dusk or darkness, such as muzzle flash or illuminated vehicles, can be fired at precisely, as the aims are illuminated.

The sighting device is preferably mounted onto the corresponding rifle grenade device. Thus, the sighting device remains adjusted, even if the rifle grenade device is attached to the gun with tolerance, or is attached to another gun on which other connecting elements may be used to attach the rifle grenade device.

The sighting device is an open sighting device, particularly as this requires such a relatively large optical distance in any case. Such an open sighting device (i.e., a sighting device comprising the front sight, on the one hand, and the rear sight, frame sight, etc., on the other hand), is robust and easy to manufacture.

The sight carrier 17 is detachable from the carrier component 15, so that the sight carrier 17 can be turned around relative to the carrier component 15 during switching of the mounting device, even though the carrier component 15 must also be turned around. The sight carrier 17 is preferably screwed to and detachable from the carrier component 15. Naturally the sight carrier 17 must be centered, either with screws and fitted pins or with a raised portion of the sight carrier 17 symmetrical to the longitudinal axis of the weapon with a complementary groove on the carrier component 15. The sight carrier 17 preferably features a longitudinal groove 31 whose lateral walls tightly encompass the carrier component 15 on both sides.

The open sighting device features a front sight 27 and a rear sight blade 21, 21'. These two elements 21, 21', 27 can be tilted down onto the sight carrier 17; each then becoming lodged in its own protected groove. Thus, the sighting device is protected against damage when not in use. As it is then inserted into grooves on the sight carriers 17, even dropping the weapon cannot cause the sighting device to become maladjusted.

A rear sight blade 21, 21' suited for the sighting device at hand is a so-called frame sight (i.e., an oblong, upright frame with a slide holding a rear sight running along its side limbs). There is writing on the frame limbs that identifies the shooting distance on the basis of the set height of the slide.

However, two other alternative examples are considered especially advantageous. In one example, the rear sight blade 21' is made of transparent material. In this case, the rear sight blade 21' is simply a basic strip of such material. The contours of rear sights and possibly corresponding lettering are superimposed onto this strip. Thus, for the marksman the target is not obscured by the rear sight 21', as is normally the case. Instead, he has the entire target in view, as is the case with a telescopic sight. However, the rear sight line is superimposed on the target. Another advantage of such a rear sight blade 21' is that it does not have any grooves in which grime could become lodged. It is disadvantageous, however, that the transparent rear sight blade 21' swallows light and that it must be replaced after prolonged use, as it becomes scratched. Although this scratching would be minor if glass were used, the use of glass would be disadvantageous in other ways. Transparent plastic, especially polycarbonate, is preferred as a material for the rear sight blade 21'. Such a plastic rear sight blade 21' is an inexpensive injection molded part. A number of rear sight blades 21' could be included with each new weapon, so that they could be replaced from time to time.

In an alternative example, the rear sight blade 21 is made of opaque material into which superimposed grooves are introduced. Each of the grooves is delineated on the bottom by a rear sight-shaped edge. The lettering is located adjacent to the grooves or punched-out areas. For reasons of cost and weight, this rear sight blade 21 is also preferably made of plastic.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A firearm comprising:

an automatic weapon having a barrel and a hand guard;

a grenade launcher attached underneath the barrel of the automatic weapon near the hand guard;

an open sighting device dedicated to the grenade launcher, the sighting device having an off-center line of sight and including:

at least two mounting surfaces located opposite the center of the firearm on both sides thereof, and being located at both sides of the grenade launcher near the hand guard;

a carrier component for selective attachment of the sighting device to either of the at least two mounting surfaces;

a sight carrier detachably attached to the carrier component such that, upon detaching the carrier component and the sight carrier from a first one of the at least two mounting surfaces and reattaching the carrier component and the sight carrier to a second one of the at least two mounting surfaces, the sight carrier can be detached from the carrier component, reversed in orientation, and reattached to the carrier component, such that the sight carrier is always forwardly attachable to the carrier component on one of the at least two mounting surfaces;

a front sight on a first side of the sight carrier; and a rear sight blade on a second side of the carrier.

2. A firearm as defined in claim 1, wherein at least one screw hole is defined in each of the at least two mounting surfaces for receiving at least one screw to secure the carrier component.

3. A firearm as defined in claim 1, wherein each of the at least two mounting surfaces comprises at least two partial surfaces, each of the at least two partial surfaces being disposed in a plane on a respective side of the firearm.

4. A firearm as defined in claim 1, wherein the sight carrier is secured to the carrier component with at least one screw.

5. A firearm as defined in claim 1, wherein the first sight can be tilted, the second sight blade can be tilted, the upper side of the sight carrier defines at least one recess dimensioned to receive at least one of the first sight and the second sight blade when the at least one of the first sight and the second sight blade are suitably tilted.

6. A firearm as defined in claim 5, wherein the second sight blade is made of transparent material onto which target marks are superimposed.

7. A firearm as defined in claim 5, wherein the second sight blade is at least partially opaque, and target markers are engraved on the second sight blade.

8. A firearm as defined in claim 1, wherein the at least two mounting surfaces are located on the grenade launcher.

* * * * *